US007859491B2

(12) United States Patent
Lee et al.

(10) Patent No.: US 7,859,491 B2
(45) Date of Patent: Dec. 28, 2010

(54) PIXEL CIRCUIT OF ORGANIC LIGHT EMITTING DISPLAY

(75) Inventors: Hong Koo Lee, Incheon (KR); Sang Hoon Jung, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 855 days.

(21) Appl. No.: 11/798,856

(22) Filed: May 17, 2007

(65) Prior Publication Data

US 2007/0268220 A1 Nov. 22, 2007

(30) Foreign Application Priority Data

May 18, 2006 (KR) ..... 10-2006-0044685

(51) Int. Cl.
*G09G 3/30* (2006.01)

(52) U.S. Cl. ..... 345/76; 345/82

(58) Field of Classification Search ..... 345/76; 315/169.4

See application file for complete search history.

(56) References Cited

U.S. PATENT DOCUMENTS 6,774,877 B2 * 8/2004 Nishitoba et al. ..... 345/76
6,930,680 B2 * 8/2005 Miyazawa ..... 345/76
7,187,351 B2 * 3/2007 Kwon ..... 345/76
7,205,966 B2 * 4/2007 Numao ..... 345/76
7,518,580 B2 * 4/2009 Kwon ..... 345/76
7,573,441 B2 * 8/2009 Kwon ..... 345/76
2005/0243040 A1 * 11/2005 Miyazawa ..... 345/76
2006/0077137 A1 * 4/2006 Kwon ..... 345/76
2007/0063935 A1 * 3/2007 Yoshida ..... 345/76
2007/0200793 A1 * 8/2007 Kwon ..... 345/204

* cited by examiner

*Primary Examiner*—Chanh Nguyen
*Assistant Examiner*—Adam J Snyder
(74) *Attorney, Agent, or Firm*—Morgan Lewis & Bockius LLP

(57) ABSTRACT

The pixel circuit of an organic light emitting display includes a first transistor to a seventh transistor, a first capacitor, a second transistor and an organic light emitting diode. The first capacitor stores the data signal from the first, second and third transistors, and the second capacitor stores the threshold voltage of the fourth transistor from the fifth transistor. Voltages stored in the first and second capacitors are combined by the sixth transistor, and the fourth transistor generates a driving current corresponding to a combined voltage of the voltages stored in the first and second capacitor. The seventh transistor transmits the driving current and the organic light emitting diode emits light corresponding to the driving current.

17 Claims, 7 Drawing Sheets

PIXEL CIRCUIT OF ORGANIC LIGHT EMITTING DISPLAY

This application claims the benefit of Korea Patent Application No. 10-2006-044685, filed in Korea on May 18, 2006, which is incorporated herein by reference.

BACKGROUND OF THE INVENTION

1. Field of the Invention

The present invention relates to a pixel circuit of an organic light emitting display.

2. Discussion of the Related Art

There are various types of flat panel displays such as liquid crystal displays (LCDs), plasma display panels (PDPs), field emission displays (FEDs), organic light emitting displays, which have been put into practical use. With the growth of the multimedia society, the flat panel displays have been in great demand. Among these flat panel displays, the organic light emitting display has rapid response time, low power consumption, and a self-emission structure. Also, the organic light emitting display has a wide viewing angle, thereby displaying excellent moving pictures regardless of the size of the screen or the position of a viewer. Moreover, the organic light emitting display can be manufactured in a low temperature environment by a semiconductor fabrication process, which is a simple manufacturing process. For these reasons, the organic light emitting display has attracted considerable attention as the next generation display.

In general, the organic light emitting display emits light by electrically exciting an organic compound. To display a predetermined image, the organic light emitting display is provided with N×M organic light emitting diodes that are arranged in a matrix format, and may be voltage driven or current driven. The methods for driving the organic light emitting display may include a passive matrix type and an active matrix type that uses a thin film transistor. In the passive matrix type, an anode electrode is at a right angle to a cathode electrode. The anode electrode is selected by a scan signal and the cathode electrode receives a data signal, so that an organic light emitting diode (OLED) emits light in response to the data signal applied between the cathode electrode and the anode electrode. In the active matrix type, the thin film transistor is connected to an ITO (Indium Tin Oxide) electrode and has its gate electrode connected to a capacitor, so that the OLED emits light depending on a voltage stored in the capacitor.

FIG. 1 is a block diagram schematically illustrating an organic light emitting display according to the related art. Referring to FIG. 1, the related art organic light emitting display includes a display panel 110, a scan driver 120, a data driver 130, a controller 140, and a power supply 150. The display panel 110 is provided with a plurality of data lines D1-Dm, scan lines S1-Sn and pixel circuits P11-Pnm. The data lines D1-Dm may be arranged in a first direction, crossing the scan lines S1-Sn arranged in a second direction. The pixel circuits P11-Pnm are disposed at pixel areas that are defined by the data lines D1-Dm and the scan lines S1-Sn. The controller 140 serves to output control signals to the scan driver 120, the data driver 130 and the power supply 150. The power supply 150 serves to output necessary voltages to the scan driver 120, the data driver 130 and the display panel 110 in response to the control signals received from the controller 140. The scan driver 120 serves to output scan signals to the scan lines S1-Sn connected to the scan driver 120 in response to the control signals of the controller 140. Thus, the pixel circuits P11-Pnm of the display panel 110 are selected by the scan signals. The data driver 130 serves to output data signals, which are synchronized with the scan signals, to the data lines D1-Dm connected to the data driver 130 in response to the control signals of the controller 140. Then, the data driver 130 applies the data signals to the corresponding pixel circuits P11-Pnm through the data lines D1-Dm. Thus, the pixel circuits P11-Pnm emit light in response to the data signals, thereby displaying a predetermined image on the display panel 110.

FIG. 2 is a circuit diagram schematically illustrating a pixel circuit of the organic light emitting display according to the related art. Referring to FIG. 2, the pixel circuit includes a switching transistor MS, a capacitor Cgs, a driving transistor MD, and an organic light emitting diode (OLED). The switching transistor MS serves to transmit a data signal from a data line Dm in response to a scan signal from a scan line Sn. The data signal received through the switching transistor MS is stored in the capacitor Cgs. The data signal stored in the capacitor Cgs is used to generate a driving current for the driving transistor MD. Thus, the OLED emits light depending on the driving current. A driving current $I_{OLED}$ flowing into the OLED may be expressed by the following Equation 1.

$$I_{OLED} = \frac{1}{2}K(Vgs - Vth)^2 \quad \text{[Equation 1]}$$

Wherein, Vgs denotes a source-gate voltage of the driving transistor MD, and Vth denotes a threshold voltage of the driving transistor MD.

The organic light emitting display having the pixel circuit may be an active matrix type, and may control a luminance by the current $I_{OLED}$ flowing into the OLED. Accordingly, uniformity of characteristics of thin film transistors, particularly, uniformity of the threshold voltages and mobility of thin film transistors should be achieved in order to have a uniform display. The thin film transistor used in the organic light emitting display may be formed using amorphous silicon or low temperature poly-silicon. Since field-effect mobility of the poly-silicon is 100 to 200 times larger than that of the amorphous silicon, the importance of the thin film transistor using the poly-silicon has increased.

However, the poly-silicon may be manufactured by crystallization of the amorphous silicon using an eximer laser to anneal the amorphous silicon. When the amorphous silicon is crystallized, grain size of the poly-silicon may not be uniform due to non-uniformity of the pulse amplitude produced by the eximer laser. As a result, the thin film transistors have different characteristics such that each pixel may have a different brightness at the same gray level.

SUMMARY OF THE INVENTION

The present invention is to provide a pixel circuit of an organic light emitting display including a first transistor to transmit a data signal from a data line in response to a selection signal from a scan line, a second transistor to transmit the data signal from the first transistor in response to the selection signal from the scan line, a third transistor diode-connected to transmit the data signal by the second transistor, a first capacitor to store the data signal from the third transistor, a fourth transistor to generate a driving current, a fifth transistor connecting a gate electrode and a drain electrode of the fourth transistor in a diode-connected configuration to store a threshold voltage of the fourth transistor in response to the selection signal from the scan line, a second capacitor to store the threshold voltage of the fourth transistor, a sixth transistor to transmit a combined voltage of the first and second capacitors to the fourth transistor to generate the driving current in response to the selection signal from the scan line, a seventh transistor to transmit the driving current generated in the firth transistor, and an organic light emitting diode to emit light corresponding to the driving current from the seventh transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention and together with the description serve to explain the principles of the invention. In the drawings.

DETAILED DESCRIPTION OF THE EMBODIMENTS

Reference will now be made in detail to the embodiments of the present invention, examples of which are illustrated in the accompanying drawings.

Figure 1:
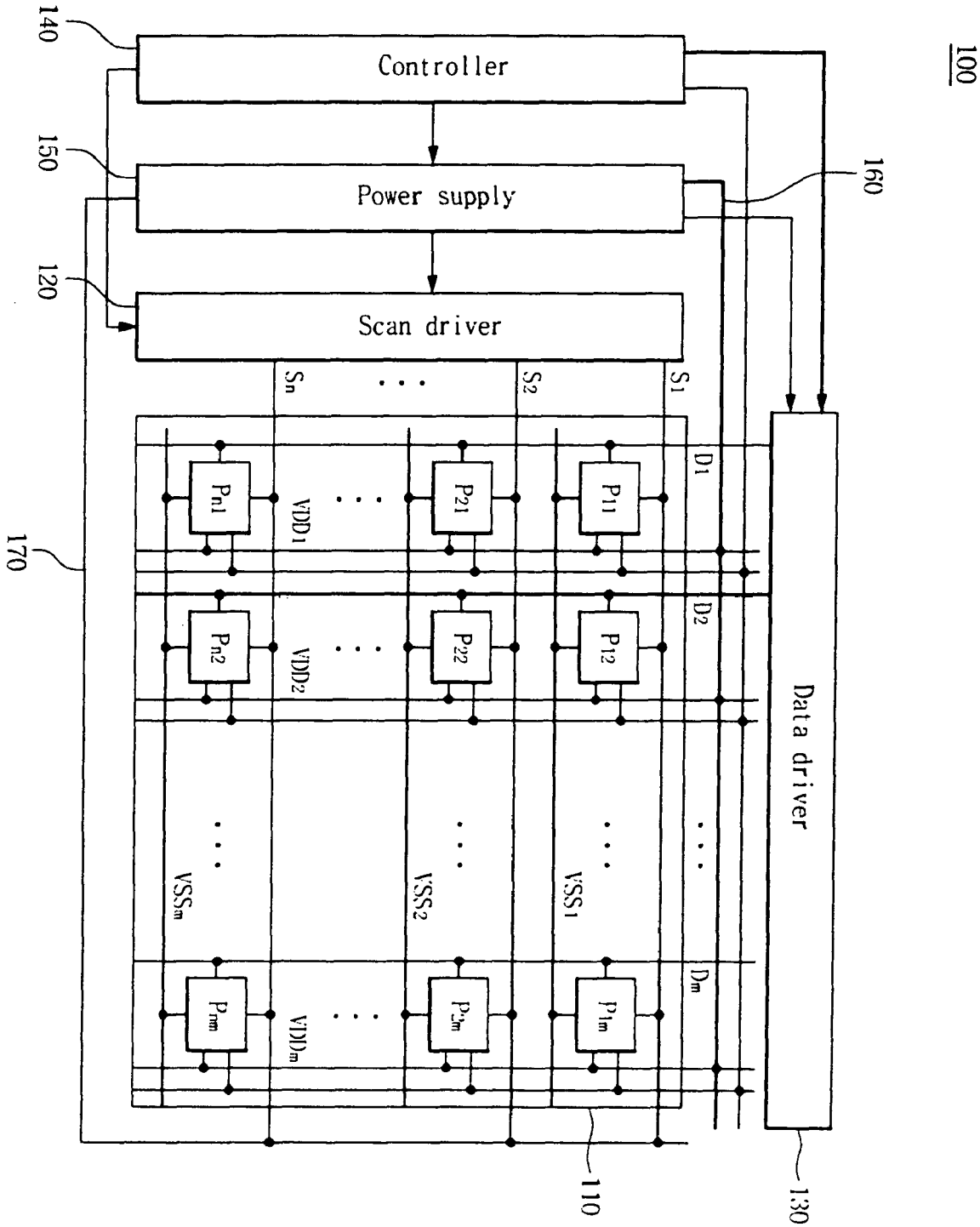
FIG. 1 (Related Art)
FIG. 1 is a block diagram schematically illustrating an organic light emitting display according to the related art.
Figure 2:
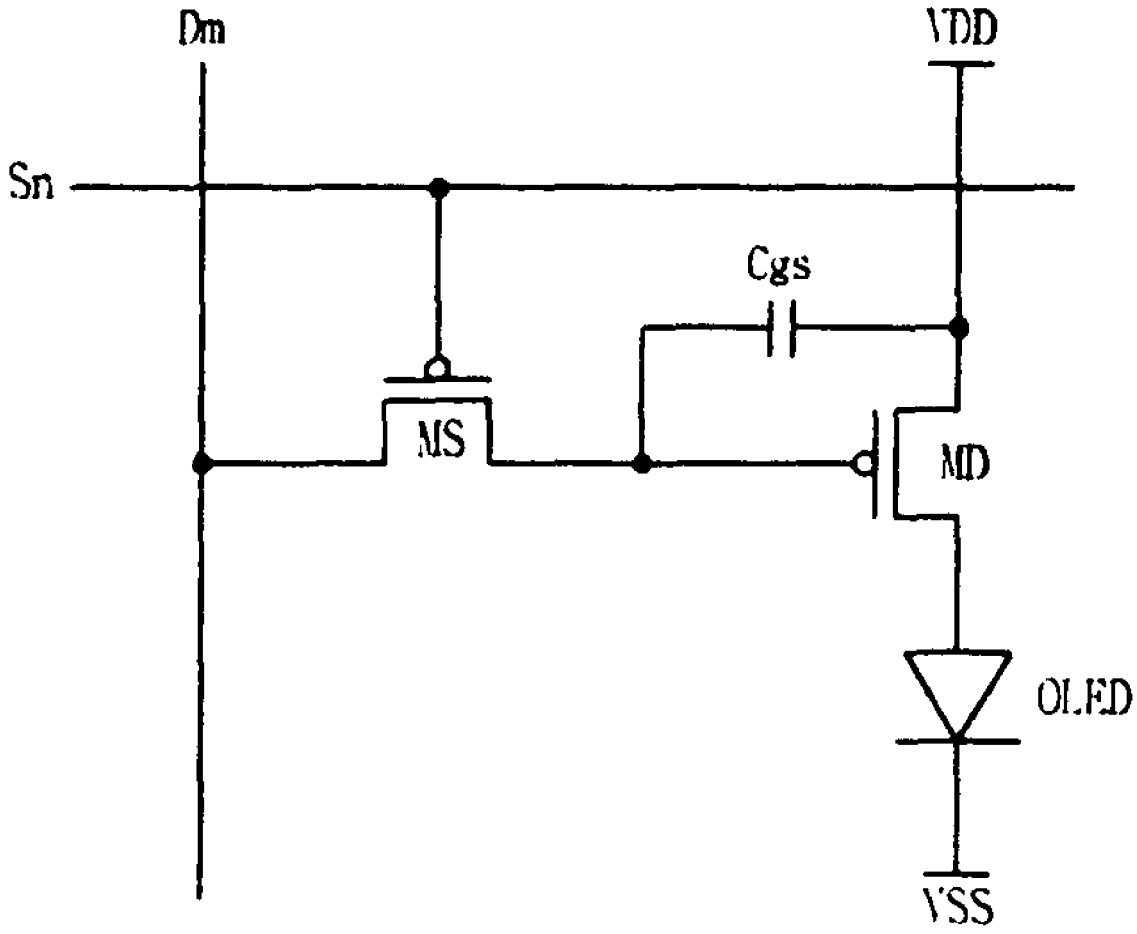
FIG. 2 (Related Art)
FIG. 2 is a circuit diagram schematically illustrating a pixel circuit of the organic light emitting display according to the related art.
Figure 3A:
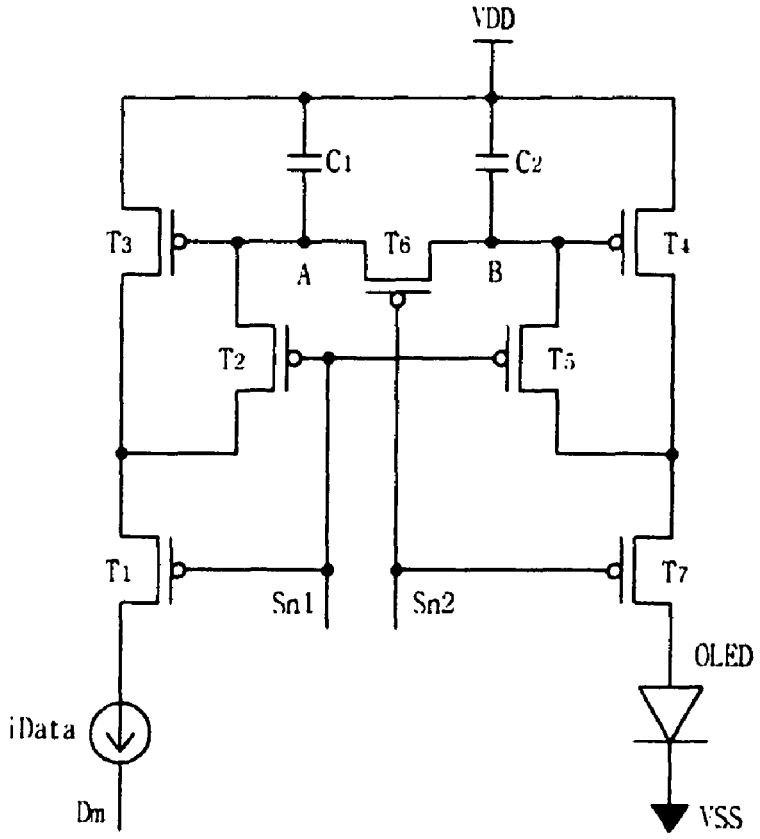
FIG. 3A is a circuit diagram schematically illustrating a pixel circuit of an organic light emitting display according to a first exemplary embodiment.

FIG. 3A is a circuit diagram schematically illustrating a pixel circuit of an organic light emitting display according to a first exemplary embodiment. Referring to FIG. 3A, a first transistor T1 has a first (gate) electrode connected to a first scan line Sn1, and has a second (source/drain) electrode connected to a data line Dm. Thus, the first transistor T1 transmits a data signal from the data line Dm in response to a selection signal from the first scan line Sn1.

A second transistor T2 has a first (gate) electrode connected to the first scan line Sn1, a second electrode connected to a first (gate) electrode of a third transistor T3, and a third electrode connected to a second electrode of the third transistor T3. Thus, when a selection signal is applied through the first scan line Sn1, the third transistor T3 is diode-connected by the second transistor T2. Since the third transistor T3 is diode-connected by the second transistor T2, the third transistor T3 receives a data signal from the first transistor T1 and a voltage corresponding to the data signal is stored in a first capacitor C1 connected to a third electrode of the third transistor T3.

A fifth transistor T5 has a first (gate) electrode connected to the first scan line Sn1 as the same way as the first and second transistors T1 and T2. When a selection signal is applied through the first scan line Sn1, the fifth transistor T5 is turned on such that a fourth transistor T4 is diode-connected by the turned-on fifth transistor T5. The fourth transistor T4 has a first (gate) electrode connected to a first electrode of a second capacitor C2, and a first power supply line VDD is connected to a second electrode of the second capacitor C2. Thus, a threshold voltage of the fourth transistor T4 is stored in the second capacitor C2.

A sixth transistor T6 has a first (gate) electrode connected to a second scan line Sn2, a second electrode connected to the first electrode of the second capacitor C2, and a third electrode connected to a first electrode of the first capacitor C1. When a selection signal is applied through the second scan line Sn2, the sixth transistor T6 is turned on such that voltages stored in the first and second capacitors C1 and C2 are combined (rearranged) at a predetermined ratio and the combined (rearranged) voltage is applied to the gate electrode of the fourth transistor T4. A seventh transistor T7 has a gate electrode connected to the second scan line Sn2. When a selection signal is applied through the second scan line Sn2, the seventh transistor T7 is turned on such that a driving current generated in the fourth transistor T4 is applied to an organic light emitting diode (OLED).

Figure 3B:
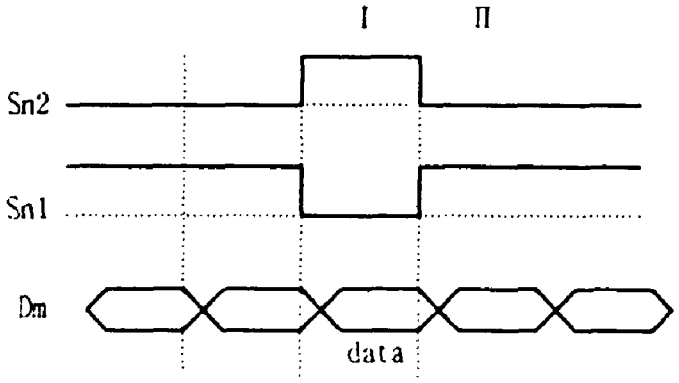
FIG. 3B is a timing diagram schematically illustrating an operation of the pixel circuit of FIG. 3A according to the first exemplary embodiment.

As shown in FIG. 3A, the first capacitor C1 has its second electrode connected to the first power supply line VDD, and the second capacitor C2 also has its second electrode connected to the first power supply line VDD. The first and second capacitors C1 and C2 have their first electrodes connected to the second and third electrodes of the sixth transistor T6, respectively. The third and fifth transistors T3 and T5 may be mirror-transistors each having the same threshold voltage and the same mobility FIG. 3B is a timing diagram schematically illustrating an operation of the pixel circuit of FIG. 3A according to the first exemplary embodiment. Referring to FIG. 3B, the operation of the pixel circuit includes a programming step I and a light-emitting step II. In the programming step I, a low level signal is applied through the first scan line Sn1, and a high level signal is applied through the second scan line Sn2. Due to the low level signal, the first and second transistors T1 and T2 are turned on, and the third transistor T3 is diode-connected by the turned-on second transistor T2 and receives a data signal from the first transistor T1. That is, the gate electrode and the second (drain) electrode of the third transistor T3 are electrically connected to each other by the turned-on second transistor T2. The data signal may be a current $I_{data}$, and may be sunk through the data line Dm. The first capacitor C1 stores a voltage (i.e., a threshold voltage of the third transistor T3) corresponding to the data signal $I_{data}$ and a voltage having compensated mobility.

A node A (of FIG. 3A) has a voltage $V_A$ that may be expressed by the following Equation 2.

[Equation 2]

$$I_{data} = \frac{1}{2}K_3(V_A - Vdd - Vth)^2 \quad (1)$$

$$V_A = Vdd + Vth - \sqrt{\frac{2I_{data}}{K_3}} \quad (2)$$

When the low level signal is applied through the first scan line Sn1, the fifth transistor T5 is turned on, thereby diode-connecting the gate electrode and a drain electrode of the fourth transistor T4. A threshold voltage of the fourth transistor T4 is stored in the second capacitor C2. A node B (of FIG. 3A) has a voltage $V_B$ that may be expressed by the following Equation 3.

$$V_B = Vdd + Vth \quad \text{[Equation 3]}$$

Next, in the light-emitting step II, a low level signal is applied through the second scan line Sn2, and a high level signal is applied through the first scan line Sn1. The sixth and seventh transistors T6 and T7, to which the low level signal is applied, are turned on. When the sixth transistor T6 is turned on, voltages stored in the first and second capacitors C1 and C2 are combined at a predetermined ratio and the combined voltage is applied to the gate electrode of the fourth transistor T4.

The first capacitor C1 stores a voltage corresponding to the data signal $I_{data}$ applied in the programming step I, and the second capacitor C2 stores a voltage reflecting the threshold voltage of the fourth transistor T4 in the programming step I. Accordingly, the voltages stored in the first and second capacitors C1 and C2 are combined (rearranged) so that the threshold voltages and the mobility of the third and fourth transistors T3 and T4 are reflected in a predetermined ratio. Since the first and second capacitors C1 and C2 are connected in parallel to each other, the voltage $V_B$ of the node B may be expressed by the following Equation 4.

$$V_A = Vdd + Vth - \sqrt{\frac{2I_{data}}{K_3}} \quad \text{[Equation 4]}$$

When the combined voltage of the first and second capacitors C1 and C2 is applied to the gate electrode of the fourth transistor T4, the fourth transistor T4 generates a driving current $I_{ds_T4}$, and the driving current $I_{ds_T4}$ is applied to the OLED by the turned-on seventh transistor T7. The driving current $I_{ds_T4}$ generated by the fourth transistor T4 may be expressed by the following Equation 5.

$$I_{ds-T_4} = \frac{1}{2}K_4(V_B - Vdd - Vth)^2 \quad \text{[Equation 5]}$$

The driving current $I_{ds_T4}$ is obtained by substituting the above Equation 2(3) for the above Equation 4 and then arranging the above Equation 5 using a value obtained by the substitution. The driving current $I_{ds_T4}$ may be expressed by the following Equation 6.

$$I_{ds-T_4} = \frac{K_4}{K_3}\left(\frac{C_1}{C_1 + C_2}\right)^2 I_{data} \quad \text{[Equation 6]}$$

$$\left(K_3 = \mu C_{ox}\frac{W_{T_3}}{L_{T_3}},\ K_4 = \mu C_{ox}\frac{W_{T_4}}{L_{T_4}}\right)$$

Wherein μ denotes field-effect mobility, $C_{ox}$ denotes capacitance of an insulating layer, W denotes a channel width, and L denotes a channel length. As shown in the above Equation 6, the data signal $I_{data}$ applied in the programming step I is reduced to a predetermined ratio, and then the reduced data signal $I_{data}$ may flow into the OLED. In the related art, a low gray level does not have an adequate luminance due to a low data signal and parasitic capacitance. However, since the pixel circuit of the organic light emitting display according to the first exemplary embodiment may receive a sufficient data current, a luminance of a low gray level may be displayed.

Since a current flowing into the OLED may be determined by a channel width (W) to channel length (L) ratio (W/L) of each of the third and fourth transistors T3 and T4, a ratio of an input current (i.e., the data signal $I_{data}$) to an output current (i.e., the current flowing into the OLED) may be reduced by increasing W/L of the third transistor T3. Moreover, the current flowing into the OLED may be determined by a ratio of capacitances of the first and second capacitors C1 and C2. Therefore, the pixel circuit is designed so that characteristics of the fourth transistor T4 functioning as a driving transistor can be optimized by controlling the capacitances of the first and second capacitors C1 and C2.

Figure 4A:
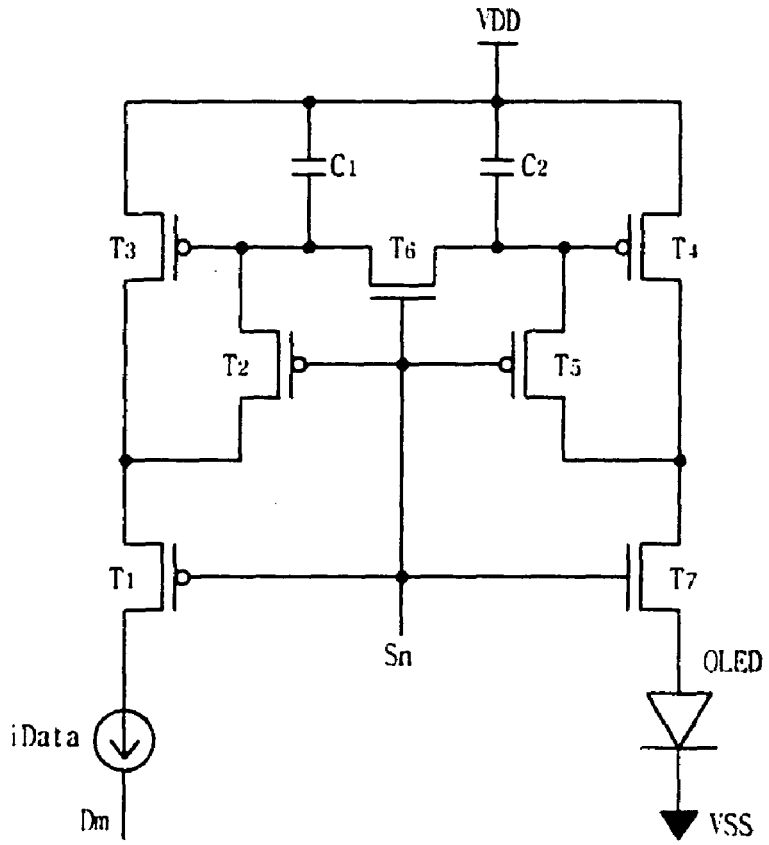
FIG. 4A is a circuit diagram schematically illustrating a pixel circuit of an organic light emitting display according to a second exemplary embodiment.
Figure 4B:
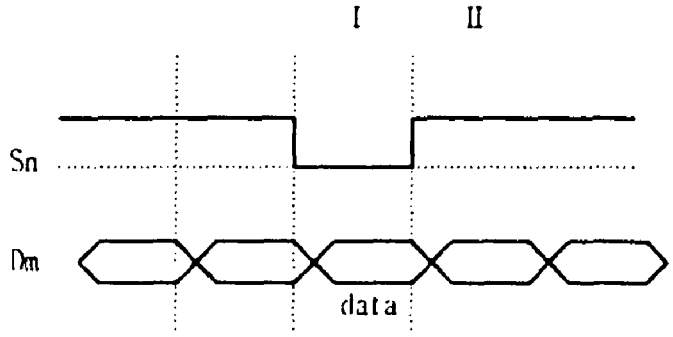
FIG. 4B is a timing diagram schematically illustrating an operation of the pixel circuit of FIG. 4A according to the second exemplary embodiment.

FIG. 4A is a circuit diagram schematically illustrating a pixel circuit of an organic light emitting display according to a second exemplary embodiment. FIG. 4B is a timing diagram schematically illustrating an operation of the pixel circuit of FIG. 4A according to the second exemplary embodiment. Referring to FIGS. 4A and 4B, the pixel circuit of the second exemplary embodiment has the same configuration as the pixel circuit of the first exemplary embodiment except that gate electrodes of first, second, fifth, sixth and seventh transistors T1, T2, T5, T6 and T7 are commonly connected to one scan line Sn.

The first, second and fifth transistors T1, T2 and T5 may be a p-channel metal-oxide semiconductor (PMOS) transistor. The sixth and seventh transistors T6 and T7 may be an n-channel metal-oxide semiconductor (NMOS) transistor. Thus, when a low level signal is applied through the scan line Sn in a programming step I, the first, second and fifth transistors T1, T2 and T5 are turned on such that a predetermined voltage is stored in first and second capacitors C1 and C2. Then, when a high level signal is applied through the scan line Sn in a light-emitting step I, the first, second and fifth transistors T1, T2 and T5 are turned off and the sixth and seventh transistors T6 and T7 are turned on such that a driving current is applied to an OLED. Since the number of signal lines is reduced in the second exemplary embodiment, the organic light emitting display is manufactured by a simple fabrication process and an aperture ratio is secured.

Figure 5A:
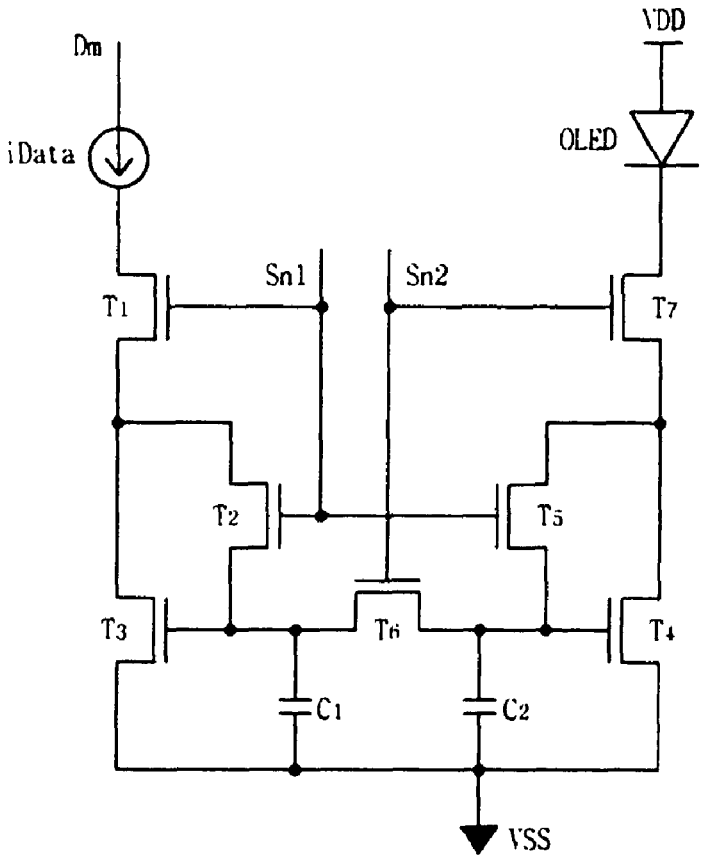
FIG. 5A is a circuit diagram schematically illustrating a pixel circuit of an organic light emitting display according to a third exemplary embodiment.
Figure 5B:
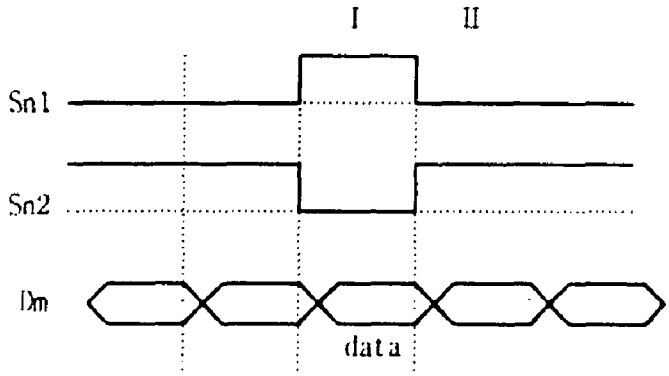
FIG. 5B is a timing diagram schematically illustrating an operation of the pixel circuit of FIG. 5A according to the third exemplary embodiment.
Figure 6A:
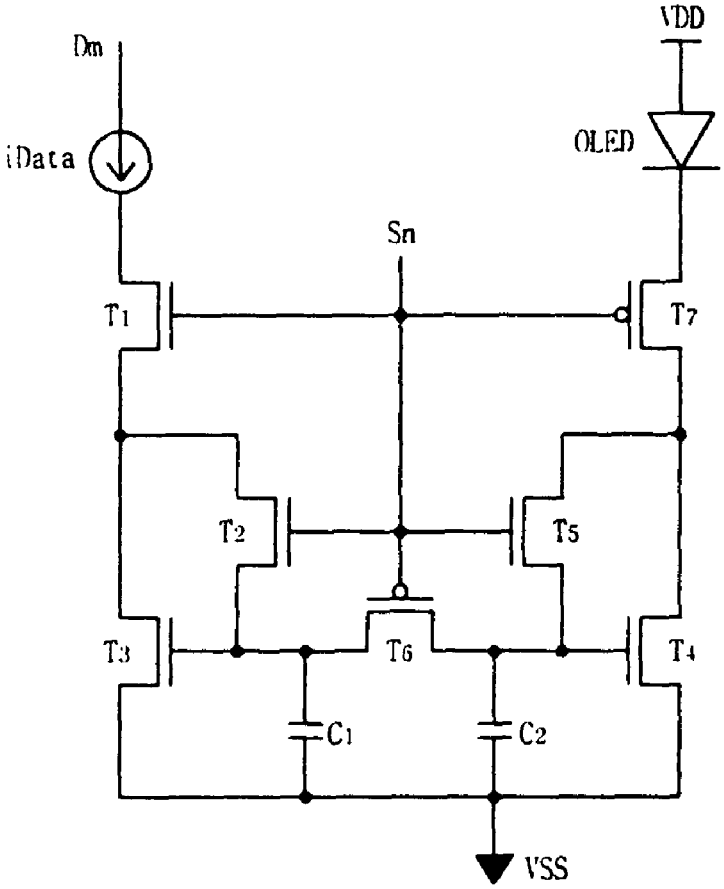
FIG. 6A is a circuit diagram schematically illustrating a pixel circuit of an organic light emitting display according to a fourth exemplary embodiment.
Figure 6B:
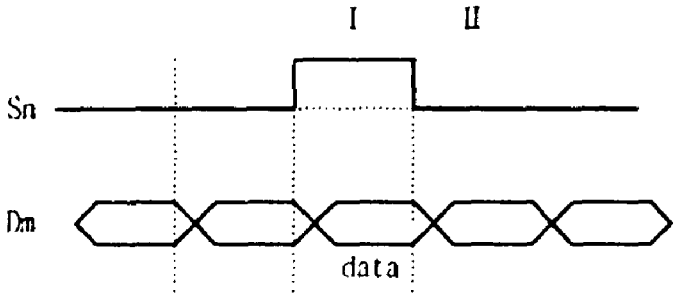
FIG. 6B is a timing diagram schematically illustrating an operation of the pixel circuit of FIG. 6A according to the fourth exemplary embodiment.

FIGS. 5A and 5B are a circuit diagram and an operation timing diagram schematically illustrating a pixel circuit of an organic light emitting display according to a third exemplary embodiment. Also, FIG. 5A is a complementary circuit of FIG. 3A, and the operation of the pixel circuit illustrated in FIG. 5B is complementary to FIG. 3B. FIGS. 6A and 6B are a circuit diagram and an operation timing diagram schematically illustrating a pixel circuit of an organic light emitting display according to a fourth exemplary embodiment. Also, FIG. 6A is a complementary circuit of FIG. 4A, and the operation of the pixel circuit illustrated in FIG. 6B is complementary to FIG. 4B. A description of FIGS. 5B and 6B is omitted.

Referring to FIGS. 5A and 6A, a first power supply line VSS connected to electrodes of first and second capacitors C1 and C2 may be a negative power supply line. An OLED may have an anode electrode connected to a second power supply line VDD that is a positive power supply line, and have a cathode electrode connected to a drain electrode of a seventh transistor T7.

Figure 7:
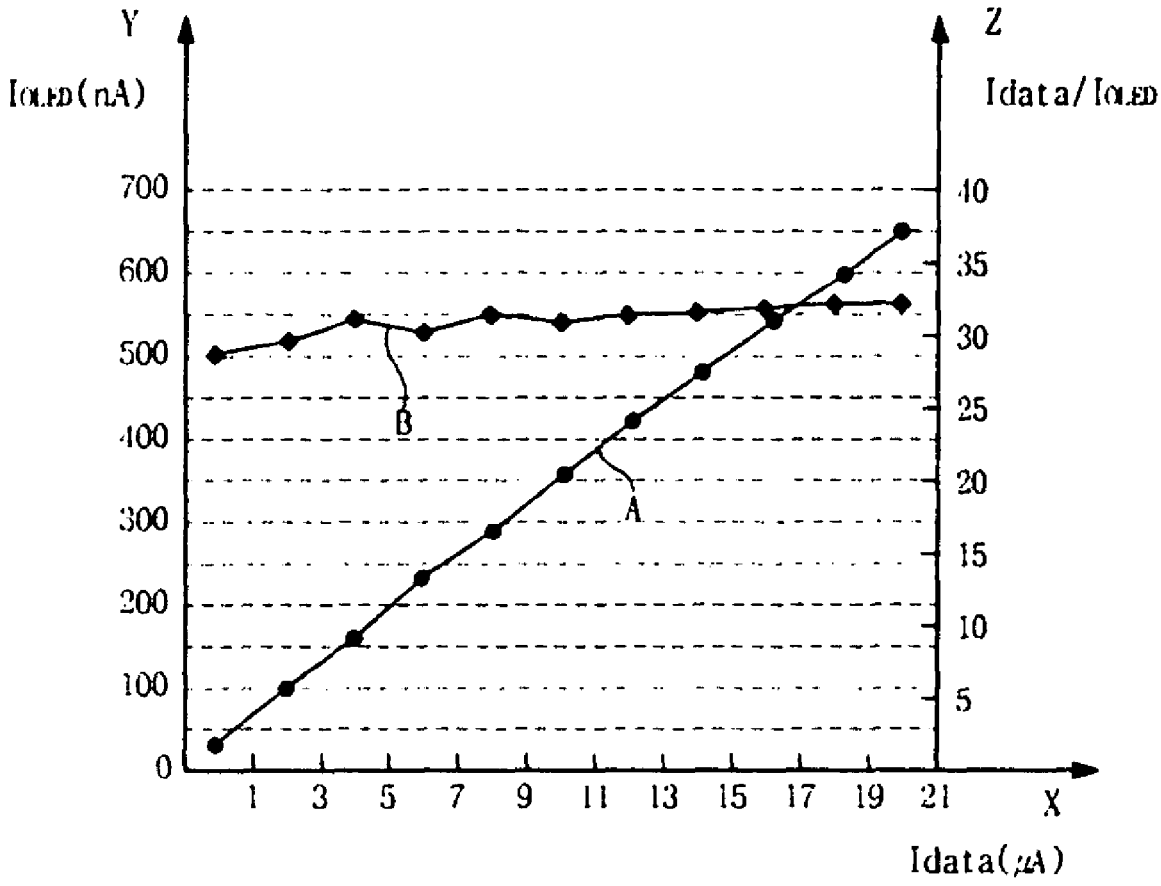
FIG. 7 is a simulation graph schematically illustrating a current flowing through an organic light emitting diode of the pixel circuit according to the first exemplary embodiment.

FIG. 7 is a simulation graph schematically illustrating a current flowing into an organic light emitting diode of the pixel circuit according to the first exemplary embodiment. Referring to FIG. 7, the pixel circuit according to the first exemplary embodiment was designed such that the first and second capacitors C1 and C2 each have capacitance of 150 fP, and the ratio $K_3$:$K_4$ of the third and fourth transistors T3 and T4 is 4:1. Graph A shows the current $I_{OLED}$ (i.e., an output current) flowing into the OLED depending on the data signal $I_{data}$ (i.e., an input current) applied in the programming step. Graph B shows a ratio of the input current $I_{data}$ to the output current $I_{OLED}$. When the input current $I_{data}$ is about 21 μA, the output current $I_{OLED}$ is about 650 nA. Accordingly, the pixel circuit according to the first exemplary embodiment can control the output current $I_{OLED}$ SO that a ratio of the input current $I_{data}$ to the output current $I_{OLED}$ is 30:1.

As described above, the pixel circuit according to the above exemplary embodiments can increase the luminance uniformity between pixels by compensating for the threshold voltages and the mobility of the driving transistors. Further, the pixel circuit can control the ratio of the input current being the data signal to the output current flowing into the OLED, thereby fully displaying luminance of a low gray level. In other words, the exemplary embodiments increase the luminance uniformity between pixels and improve the image quality of the organic light emitting display.

It will be apparent to those skilled in the art that various modifications and variations can be made in the pixel circuit of an organic light emitting display of the present invention without departing from the spirit or scope of the invention. Thus, it is intended that the present invention cover the modifications and variations of this invention provided they come within the scope of the appended claims and their equivalents.

What is claimed is:

1. A pixel circuit of an organic light emitting display comprising:

a first transistor that transmits a data signal from a data line in response to a selection signal from a scan line;

a second transistor that transmits the data signal from the first transistor in response to the selection signal from the scan line;

a third transistor that is diode-connected by the second transistor to transmit the data signal;

a first capacitor that stores the data signal from the third transistor;

a fourth transistor that generates a driving current;

a fifth transistor that connects a gate electrode and a drain electrode of the fourth transistor in a diode-connected configuration to store a threshold voltage of the fourth transistor in response to the selection signal from the scan line;

a second capacitor that stores the threshold voltage of the fourth transistor;

a sixth transistor that transmits a combined voltage of the first and second capacitors to the fourth transistor to generate the driving current in response to the selection signal from the scan line;

a seventh transistor that transmits the driving current generated in the fourth transistor; and an organic light emitting diode that emits light corresponding to the driving current from the seventh transistor.

2. The pixel circuit of claim 1, wherein the third transistor and the fourth transistor have substantially the same threshold voltage and the same mobility.

3. The pixel circuit of claim 2, wherein the third transistor includes a channel length to channel width ratio that is different from that of the fourth transistor.

4. The pixel circuit of claim 1, wherein the scan line comprises a first scan line and a second scan line, and the first, second and fifth transistors have gate electrodes commonly connected to the first scan line.

5. The pixel circuit of claim 4, wherein the sixth and seventh transistors have gate electrodes commonly connected to the second scan line.

6. The pixel circuit of claim 5, wherein the first and second capacitors have electrodes connected to a first power supply line.

7. The pixel circuit of claim 6, wherein when a low level signal is applied through the first scan line, the first, second and fifth transistors are turned on, the first capacitor stores a voltage corresponding to the data signal, and the second capacitor stores the threshold voltage of the fourth transistor.

8. The pixel circuit of claim 7, wherein when a low level signal is applied through the second scan line, the sixth and seventh transistors are turned on and the combined voltage of the first and second capacitors is applied to the gate electrode of the fourth transistor such that the fourth transistor generates the driving current and the seventh transistor applies the driving current to the organic light emitting diode.

9. The pixel circuit of claim 1, wherein the first to seventh transistors each are a p-channel metal-oxide semiconductor (PMOS) transistor.

10. The pixel circuit of claim 1, wherein the first, second, fifth, sixth and seventh transistors have gate electrodes commonly connected to the scan line.

11. The pixel circuit of claim 10, wherein the first, second and fifth transistors are each a PMOS transistor, and the sixth and seventh transistors are each an n-channel metal-oxide semiconductor (NMOS) transistor.

12. The pixel circuit of claim 1, wherein the first and second capacitors includes electrodes connected to a first power supply line, and the first power supply line is a negative power supply line.

13. The pixel circuit of claim 12, wherein the first to seventh transistors are each an NMOS transistor.

14. The pixel circuit of claim 13, wherein the organic light emitting diode includes an anode electrode connected to a second power supply line, and a cathode electrode connected to an electrode of the sixth transistor.

15. The pixel circuit of claim 12, wherein the first, second, fifth, sixth and seventh transistors are commonly connected to the same scan line.

16. The pixel circuit of claim 15, wherein the first, second and fifth transistors are each an NMOS transistor, and the sixth and seventh transistors are each a PMOS transistor.

17. The pixel circuit of claim 1, wherein the data signal is a current, and the current is sunk through the data line.

* * * * *